US011104494B2

(12) United States Patent
McGrath

(10) Patent No.: US 11,104,494 B2
(45) Date of Patent: Aug. 31, 2021

(54) NON-COCKING CONVERTIBLE CHILD RESISTANT CLOSURE

(71) Applicant: VAN BLARCOM CLOSURES, INC., Brooklyn, NY (US)

(72) Inventor: George McGrath, Brooklyn, NY (US)

(73) Assignee: VAN BLARCOM CLOSURES, INC., Brooklyn, NY (US)

( * ) Notice: Subject to any disclaimer, the term of this patent is extended or adjusted under 35 U.S.C. 154(b) by 388 days.

(21) Appl. No.: 15/999,270

(22) PCT Filed: Feb. 16, 2017

(86) PCT No.: PCT/US2017/018203

§ 371 (c)(1),
(2) Date: Aug. 17, 2018

(87) PCT Pub. No.: WO2017/143084

PCT Pub. Date: Aug. 24, 2017

(65) Prior Publication Data

US 2020/0331666 A1 Oct. 22, 2020

Related U.S. Application Data

(60) Provisional application No. 62/296,389, filed on Feb. 17, 2016.

(51) Int. Cl.
*B65D 50/04* (2006.01)
*B65D 50/06* (2006.01)

(52) U.S. Cl.
CPC ..... *B65D 50/041* (2013.01); *B65D 50/046* (2013.01); *B65D 50/061* (2013.01); *B65D 2215/02* (2013.01); *B65D 2251/09* (2013.01)

(58) Field of Classification Search
CPC ..... B65D 50/00–061; B65D 50/041; B65D 50/046; B65D 50/061; B65D 2215/00–08; B65D 2251/09; B65D 2251/08
See application file for complete search history.

(56) References Cited

U.S. PATENT DOCUMENTS 3,809,272 A * 5/1974 Maki ..... B65D 50/041 215/219
3,830,394 A * 8/1974 Lestaevel ..... B65D 55/145 215/206

(Continued)

FOREIGN PATENT DOCUMENTS

KR 20120030495 A * 3/2012 ..... B65D 50/041
WO WO-2004063025 A2 * 7/2004 ..... B65D 50/041
WO WO-2006098559 A1 * 9/2006 ..... B65D 50/041

*Primary Examiner* — J. Gregory Pickett
*Assistant Examiner* — Abigail Elizabeth Guidry
(74) *Attorney, Agent, or Firm* — Cozen O'Connor

(57) ABSTRACT

A convertible child resistant closure for use with a container having a threaded portion adjacent the container opening allows a user to select between a child resistant closure and an easily openable closure and includes coaxial inner and outer caps. The inner cap has a cover wall and a side wall. The side wall includes an inner surface having a threaded portion for engagement with a threaded container opening, and an outer surface including a child resistant portion comprising a series of angular abutments extending thereabout and a non-child resistant portion axially offset from said child resistant portion. Features of a side wall of the outer cap selectively engage features of the inner cap side wall in either a configuration for the child resistant closure or a configuration for the easily openable (non-child-resistant) closure.

9 Claims, 8 Drawing Sheets

(56) References Cited

U.S. PATENT DOCUMENTS 3,853,236 A * 12/1974 Ostrowsky ..... B65D 50/041 215/220
3,915,326 A * 10/1975 Hrubesky ..... B65D 50/041 215/219
3,968,894 A * 7/1976 Herrmann ..... B65D 41/3428 215/220
4,011,960 A * 3/1977 Mauvernay ..... B65D 50/041 215/220
4,519,514 A * 5/1985 Agbay ..... B65D 55/024 215/225
5,579,934 A 12/1996 Buono
6,722,513 B1 * 4/2004 Flood ..... A61J 11/04 215/11.1
7,408,843 B2 * 8/2008 Brandon ..... A61J 7/0472 215/329
7,703,617 B1 * 4/2010 Branson ..... B65D 41/06 215/332
7,819,264 B2 * 10/2010 Brozell ..... B65D 50/043 215/222
7,988,003 B1 * 8/2011 Clodfelter ..... B65D 50/041 215/220
9,784,979 B2 * 10/2017 Crenko ..... G02B 7/022
2002/0027119 A1 * 3/2002 Miceli ..... B65D 50/041 215/204
2004/0262251 A1 * 12/2004 Tauber ..... B65D 50/041 215/220
2005/0150857 A1 7/2005 Brozell et al.
2005/0230341 A1 * 10/2005 Dong ..... B65D 39/08 215/228
2009/0014404 A1 * 1/2009 Russell ..... B65D 50/041 215/220
2009/0120896 A1 * 5/2009 Scarlata ..... B65D 50/041 215/217
2010/0313527 A1 * 12/2010 Jajoo ..... B65D 50/041 53/492
2011/0139742 A1 * 6/2011 Brozell ..... B65D 50/041 215/220
2015/0076103 A1 * 3/2015 Koller ..... B65D 50/046 215/220
2016/0031615 A1 * 2/2016 Miceli ..... A61J 1/1418 53/420
2018/0229903 A1 * 8/2018 Lee ..... B65D 47/0804
2019/0144175 A1 * 5/2019 Patton ..... B65D 41/06 215/252

* cited by examiner

NON-COCKING CONVERTIBLE CHILD RESISTANT CLOSURE

PRIORITY CLAIM

This is a U.S. national stage of application No. PCT/US2017/18203, filed on Feb. 16, 2017. Priority is claimed on U.S. Application No. 62/296,389, filed Feb. 17, 2016, the content of which is incorporated herein by reference.

BACKGROUND OF THE INVENTION

1. Field of the Invention

The present invention relates to the storage and dispensing of materials which may be harmful, particularly if improperly ingested and, more particularly, to a container closure that is selectively manipulatable between a configuration which resists opening by children and a configuration which may be easily opened without special manipulation of the closure.

2. Description of the Related Art

Child resistant closures are well-known and understood to be effective in preventing inadvertent access to potentially dangerous materials, such as medications, by children. However, inclusion of the child resistant feature on containers is costly, and all too often, makes it difficult and frustrating for an adult user to open the container, especially an adult who has suffered a loss of manual dexterity, as by arthritis. Because of deteriorating health, elderly persons tend to rely on medication more than the average person. The elderly may also tend to have impaired manual strength and dexterity. Due to the difficulty encountered by such persons in opening child-resistant packages, many elderly persons request a non-child resistant substitute. Alternatively, when medications are purchased in child resistant packages by older adults, the packages are oftentimes not reclosed by the user thus defeating the purpose of the child resistant feature.

The aforementioned problems are generally recognized by the packaging industry, particularly in connection with packaging for the pharmaceutical industry. Attempts to deal with this problem are also disclosed in the patent literature. For example, U.S. Pat. No. 3,514,003 granted to Fitzgerald on May 26, 1970 teaches a two-piece closure having a selectably engageable locking device which is engaged or disengaged by axial movement of a collar member relative to a cap member. The cap and collar members have respective sets of teeth which interlock when the collar member is moved axially upwardly into its uppermost position. The neck of the bottle also includes teeth which engage the collar member when the collar member is in the uppermost position, thus preventing rotation of the closure. To unlock the closure, the collar member is slid downward and out of engagement with the cap member. This closure visually reveals that the collar member may be moved out of engagement with the cap member. Accordingly, a child having sufficient strength to disengage the collar member may have sufficient intellect to defeat the interlocking engagement and remove the closure. Moreover, the disclosed closure arrangement is not readily adaptable to commonly available bottles and vials, such as those typically used by pharmacists for dispensing prescription medications.

Another attempt to overcome the aforementioned problem is disclosed by Do Le Minth in U.S. Pat. No. 5,148,931, granted Sep. 22, 1992, which teaches a two piece closure having two sets of axial channels on an inner cap and two sets of protrusions on an interior surface of an outer cap. The closure is opened by aligning the protrusions on the outer cap with the proper set of channels on the inner cap, pulling the outer cap up relative to the inner cap, and rotating the outer cap so as to interlock the outer and inner caps. Disadvantageously, the disclosed arrangement is mechanically complex, requiring the consumer to follow a lengthy procedure to return the closure to the child resistant state, if required. Moreover, the complicated closure structure is difficult and expensive to fabricate.

Still another attempt to overcome the aforementioned problem is disclosed by Buono in U.S. Pat. No. 5,579,934, granted Dec. 3, 1996, which teaches a convertible child resistant closure for a container. The closure includes coaxial inner and outer caps. The inner cap has a cover wall and a skirt depending therefrom. An outer surface of the skirt has a child resistant portion extending outwardly from the outer surface and made of a series of angular abutments, and a non-child resistant portion axially offset from the child resistant portion and comprising a row of longitudinally extending knurls. The outer cap has a cover wall and skirt. The inner surface of the skirt includes a child resistant region extending inwardly from the inner surface and having a plurality of angular abutments complementary to the angular abutments of the inner cap, and a non-child resistant region axially offset from the child resistant region and including a row of longitudinal knurls complementary to the knurls on the inner cap. The inner cap is axially moveable in the outer cap to select between the child resistant configuration and the non-child resistant configuration. As a result of the outwardly extending child resistant portion on the outer surface of the inner cap and the inwardly extending child resistant portion on the inner surface of the outer cap, a clearance space must be provided between the outer and inner caps to accommodate the child resistant portions. This can cause undesired play or cocking between the inner and outer caps.

It is thus desirable to provide an improved closure device that is selectively convertible between a child resistant configuration and an easily openable configuration allowing the user to choose the type of closure dependent upon the particular situation and environment in which the container is used.

SUMMARY OF THE INVENTION

Accordingly, it is an object of the present invention to provide an improved child-resistant closure for a container that is selectively convertible between a first position that provides a resistance to opening by children and a second, non-child resistance position that can readily be opened by adults, even adults having impaired manual dexterity in their fingers due to conditions such as arthritis, etc.

It is a further object to provide a closure for a container that can easily be converted at the point of packaging to provide either a child resistant configuration or an easy-to-open non-child resistant configuration, depending on the needs of the particular customer.

The present invention relates to a convertible child resistant closure for use with a container, which allows a user to select between providing the container with a child resistant closure and an easily openable closure depending upon the use and contents of the container. The closure includes co-axial inner and outer caps.

The inner cap is defined by a cover wall and a side wall or skirt depending from the cover wall. The side wall includes an inner surface engageable with the container neck, as by threads on the inner surface of the inner cap and on the neck of the container, and an outer surface including a child resistant portion comprising a series of angular abutments extending thereabout and a non-child resistant portion axially offset from the child resistant portion and preferably in the form of one or more protrusions or "balls" positioned on the outer surface of the skirt proximate the cover wall.

The outer cap has a side wall or skirt having a top edge and a bottom edge. An outer cap cover wall may optionally be provided which can be configured as an annular flange overlapping a periphery of the inner cover wall. The side wall includes an inner surface divided into a first or child resistant region and a second or non-child resistant region. The first (i.e., child resistant) region includes a plurality of angular abutment surfaces complementary to the angular abutments on the inner cap, and the second region is axially offset from the first and includes a row of sockets, each complementary to the one or more protrusions, to allow the protrusions to seat within the sockets, thereby angularly and axially locking the outer and inner caps to each other to allow them to be rotated together about the neck of the container for non-child resistant operation.

The inner cap is positioned within the outer cap and is axially movable between the first region, in which the angular surfaces on the inner cap engage the angular abutment surfaces on the outer cap to provide a child resistant closure, and the second (i.e., non-child resistant) region in which the balls engage the sockets to provide a non-child resistant closure.

The inner surface of the outer cap is also provided with an inwardly directed, restrictive projection defining a limit position of the second region. This projection defines a range of relative movement between the inner and outer cap members when positioned on a container and prevents the closure from being converted from the child-resistant configuration to the easy-to-open configuration when the closure is sealingly positioned on the container.

The abutment surfaces of the outer cap skirt are complementary to the angular abutments of the inner cap skirt so that, in the child resistant mode of operation, the angular abutments meet to cam the inner cap together with the outer cap whereby rotation of the outer cap in one direction also turns the inner cap to threadedly engage the inner cap on the container. When the outer cap is rotated in the opposite direction, i.e., the opening direction, and in the absence of an axial force on the outer cap in the direction of the inner cap, the plurality of abutment surfaces ratchet over the angular abutments, thereby preventing the rotation of the inner cap in response to rotation of the outer cap. However, by applying sufficient axial force to the outer cap toward the inner cap, such as by pressing downward on the annular flange of the outer cap, the plurality of abutment surfaces on the outer cap will be held in engagement with the angular abutments on the inner cap to impart rotation to the inner cap for removing the closure from the container.

When the protrusions or balls of the inner cap are seated in the sockets of the outer cap, the closure is in the easy-to-open, non-child resistant configuration, whereby both caps readily turn together without requiring a downward force applied to the outer cap flange, to open and close the container. Accordingly, with minimal effort, the outer and inner cap members may be turned simultaneously in either direction of rotation.

With reference to the angular abutments at the upper end of the inner cap, each of the abutments includes a sloped first surface and a substantially vertical second surface. The sloped first surface and the substantially vertical second surface meet to preferably define an angle in the range of about 30 degrees to 60 degrees therebetween, and most preferably about 45 degrees. As well, each of the plurality of abutment surfaces on the outer cap preferably define an angle with the vertical in the range of about 30 degrees to about 60 degrees and most preferably about 50 degrees.

Thus, in accordance with an embodiment of the invention, a novel closure positionable between a first child resistant position and a second non-child resistant position is provided. Accordingly, depending on whether the user desires to have the closure in a child resistant position or non-child resistant position, the inner cap member may be moved relative to the outer cap member to the selected position.

In accordance with an aspect of the invention, a closure for a container is provided, the closure being positionable between a first child resistant position and a second non-child resistant position. The closure has an outer cap having an outer cap side wall with a top edge and a bottom edge, and having an inside surface that supports a cylindrical skirt axially offset from the top edge. The outer cap side wall includes an inner surface divided into a first, child resistant region and a second, non-child resistant region, with the first region including a plurality of angularly extending abutment surfaces, and the second region being axially offset from the first region and including one of a plurality of sockets and one or more protrusions. The closure also has an inner cap having a cover wall and an inner cap side wall depending from the cover wall, the inner cap side wall having an inner surface threaded for mating engagement with a threaded exterior surface portion of an opening of the container, and an outer surface including a child resistant portion comprising a series of angular abutments extending about the outer surface and a non-child resistant portion axially offset from the child resistant portion and arranged in the form of the other of the plurality of sockets and the one or more protrusions positioned on the outer surface of the inner cap side wall proximate the cover wall. The inner cap is configured so as to be nestable within the outer cap so that the outer cap side wall is coaxial with and peripherally surrounding the inner cap side wall. Each of the sockets is complementary to the one or more protrusions, such that the closure is movable between the second non-child resistant position of the closure, in which the protrusions are removably seated within the sockets, thereby angularly and axially locking the outer and inner caps to each other to allow the outer and inner caps to be rotated together about the neck of the container for non-child resistant operation, and the first child resistant position, in the which the protrusions are not seated within the sockets and in which the closure can only be opened by application of a rotational and axial force between the plurality of angularly extending abutment surfaces of the outer cap and the angular abutments of the inner cap.

In another aspect, the plurality of sockets are arranged in the second region of the outer cap and the one or more protrusions are arranged in the child resistant portion of the inner cap.

In another aspect, the angular abutments of the inner cap comprise saw teeth having angled surfaces.

In another aspect, the angularly extending abutment surfaces of the outer cap are angled in the same direction as the angled surfaces of the saw teeth of the inner cap.

In another aspect, a bottom edge of the outer cap side wall is configured as an inwardly-extending circumferential lip such that a reduced diameter of the outer cap is presented in the region of the lip, wherein the lip is deformable such that when the inner cap is positioned in the outer cap, by inserting the inner cap top wall into the outer cap end containing the lip, a threshold force must be applied so that the inner cap squeezes past the lip, thereby causing the lip to function as a yieldable stop to retain the inner cap inside the outer cap once the inner cap is so-positioned.

In another aspect, the closure is movable by a user of the cap between the second non-child resistant position and the first child resistant position by the user applying a sufficient upwards axial force to the inner cap relative to the top wall of the outer cap so as to dislodge the balls from the sockets and move the inner cap to a position above the lip of the outer cap and into the first, child resistant, region of the outer cap.

In another aspect, the one or more protrusions comprise four balls spaced apart from each other by 90 degrees.

In another aspect, in both the first child resistant position and the second non-child resistant position, the closure can be closed by application of a rotational and axial force between the threaded inner surface of the inner cap the threaded exterior surface portion of the opening of the container.

In another aspect, in the child resistant mode, application of a rotational force to the closure to open the container, without the application of a sufficient additional downward force to the outer cap, will cause the abutment surfaces of the outer cap to ratchet or ride over the angular abutments of the inner cap, inhibiting opening of the closure.

The various features of novelty which characterize the invention are pointed out with particularity in the claims annexed to and forming a part of the disclosure. For a better understanding of the invention, its operating advantages, and specific objects attained by its use, reference should be made to the drawings and descriptive matter in which there are illustrated and described preferred embodiments of the invention.

BRIEF DESCRIPTION OF THE DRAWINGS

In the drawings, wherein like reference numerals identify similar elements throughout the several views:

FIG. 1A is a bottom perspective view of the outer cap element;

FIG. 1B is a top perspective view of the outer cap element;

FIG. 1C is a cross sectional view, taken along A-A from FIG. 1D, illustrating an interior skirt of the outer cap element;

FIG. 1D shows knurling on an outer surface of the outer cap element;

FIG. 1E is a bottom view of the outer cap element;

FIG. 1F is a close up of detail area B from FIG. 1C of a first side of the skirt;

FIG. 1G is a close up of detail area C from FIG. 1C of a second side of the skirt.

FIG. 2A is a top perspective view of the inner cap element;

FIG. 2B is a bottom perspective view of the inner cap element;

FIG. 2C is a cross sectional view, taken along A-A from FIG. 2D, illustrating an interior thread of the inner cap element;

FIG. 2D shows upper and lower features on an outer side wall of the inner cap element;

FIG. 2E is a top view of the inner cap element;

FIG. 2F is a close up of detail area B from FIG. 2D of upper features of the inner cap element;

FIG. 2G is a close up of detail area C from FIG. 2D of lower features of the inner cap element.

FIG. 3A is a perspective view of the inner cap inside a transparent illustration of the over cap;

FIG. 3B is a side view of the assembly in an engaged child resistant position;

FIG. 3C is a side view of the assembly in a disengaged child resistant position; and FIG. 3D is a side view of the assembly in a non-child resistant position.

DETAILED DESCRIPTION OF THE INVENTION

Figure 1A:
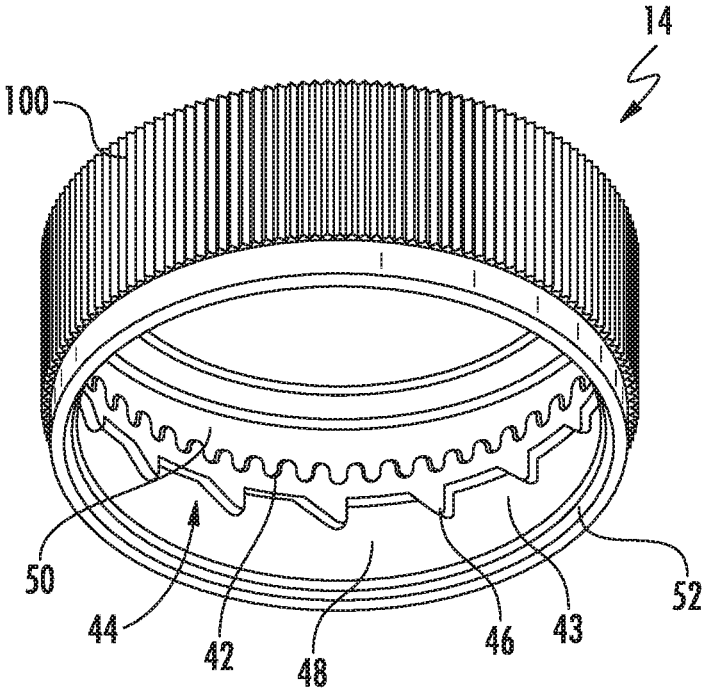
FIGS. 1A-1G are views of an outer cap element of the closure. In particular.

FIGS. 1A to 3D show a closure in accordance with the present invention and labeled generally (see, FIG. 3A) with the reference numeral 10. The closure includes an inner cap 12, described in detail with reference to FIGS. 2A to 2G, and an outer cap (also referred to herein as an "over cap") 14, described in detail with reference to FIGS. 1A to 1G. The closure 10 is constructed for use with a container having a threaded neck portion (not shown) and is primarily directed for use with containers (not shown) that store and dispense pharmaceutical products and the like but may also be used with any container having a threaded neck portion, irrespective of its contents.

As will be described in greater detail below, when the caps 12 and 14 are axially aligned and nested one within the other, selected exterior portions of the inner cap 12 engage corresponding interior portions of the outer cap 14. For this purpose, the inner cap 12 has a circular upper or top wall 16 and a cylindrical side wall 18 that depends therefrom, and the outer cap 14 has a side wall 43 having an upper edge and a lower edge (see, e.g., FIGS. 1A to 1G). Although the outer cap is depicted with a top wall 40, its inclusion is optional such that outer cap 14 can, alternatively, be constructed without the top wall.

Figure 2A:
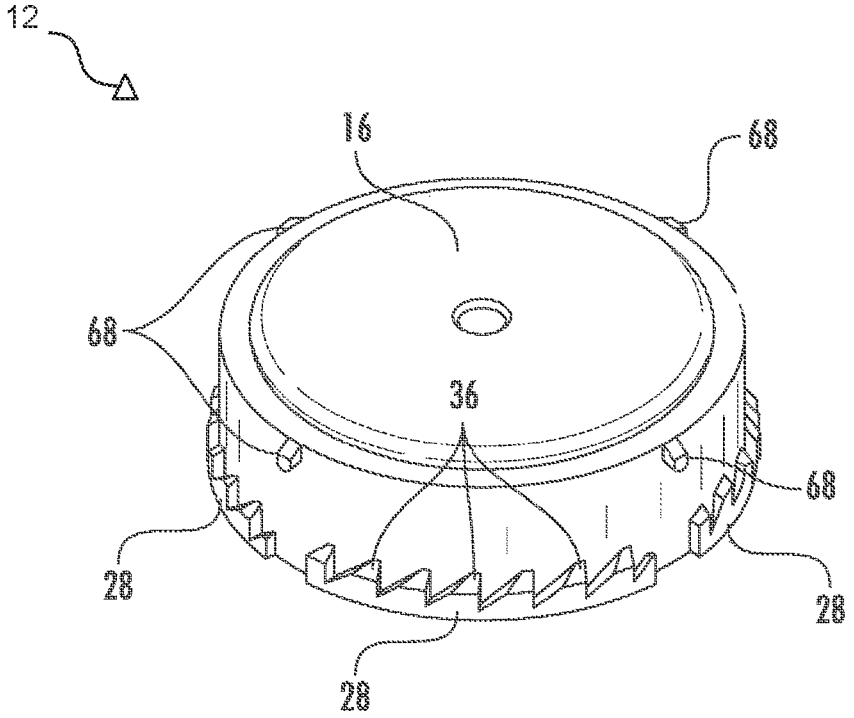
FIGS. 2A-2G are views of an inner cap element of the closure. In particular.
Figure 2B:
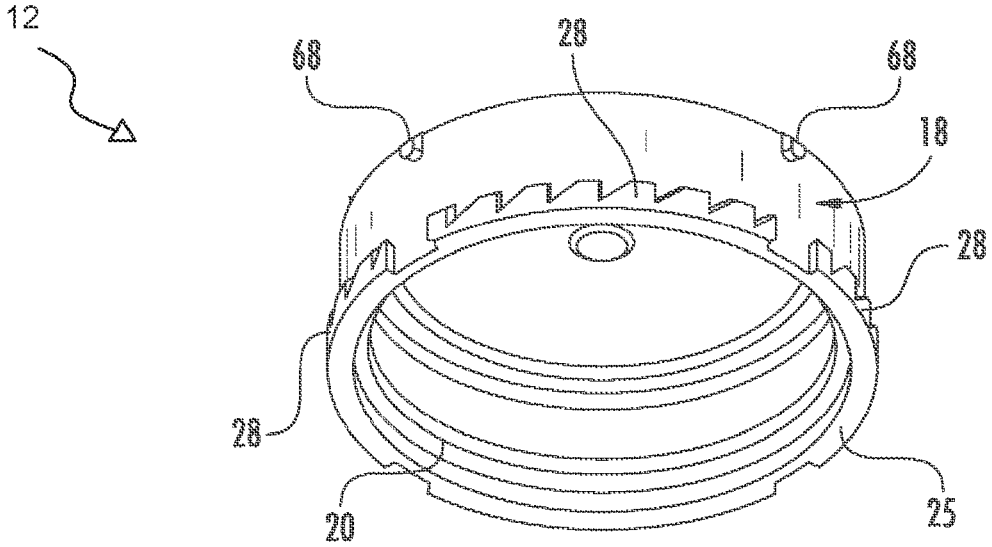
Figure 2C:
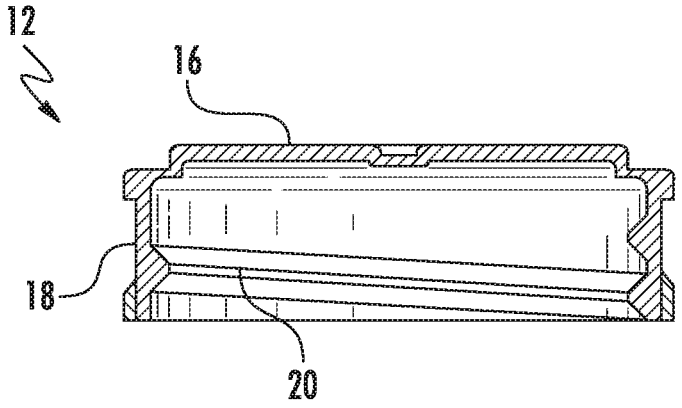
Figure 2D:
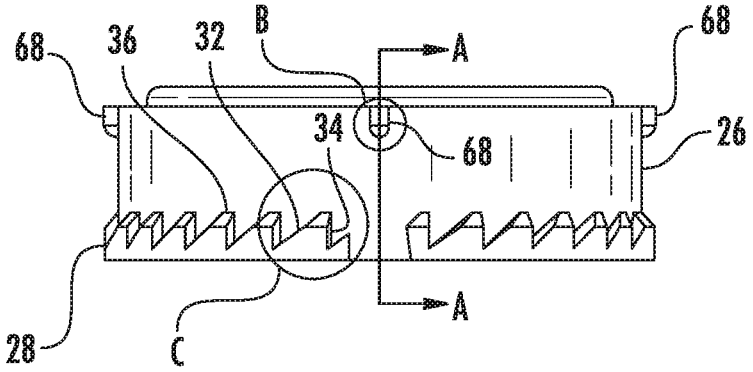

As best seen in FIGS. 2A to 2G, the inner cap 12 includes a cover wall 16 and side wall 18 depending therefrom. FIG. 2C is a section taken along A-A from FIG. 2D. An interior surface 20 of sidewall 18 is threaded for mating engagement with a threaded exterior surface portion of a container when the inner cap 12 is rotated in a closing direction, here shown by way of example to be clockwise. Conversely, the inner cap 12 may be removed from the threaded portion of the container by rotation of the former in an opening direction, e.g., counterclockwise.

Figure 2E:
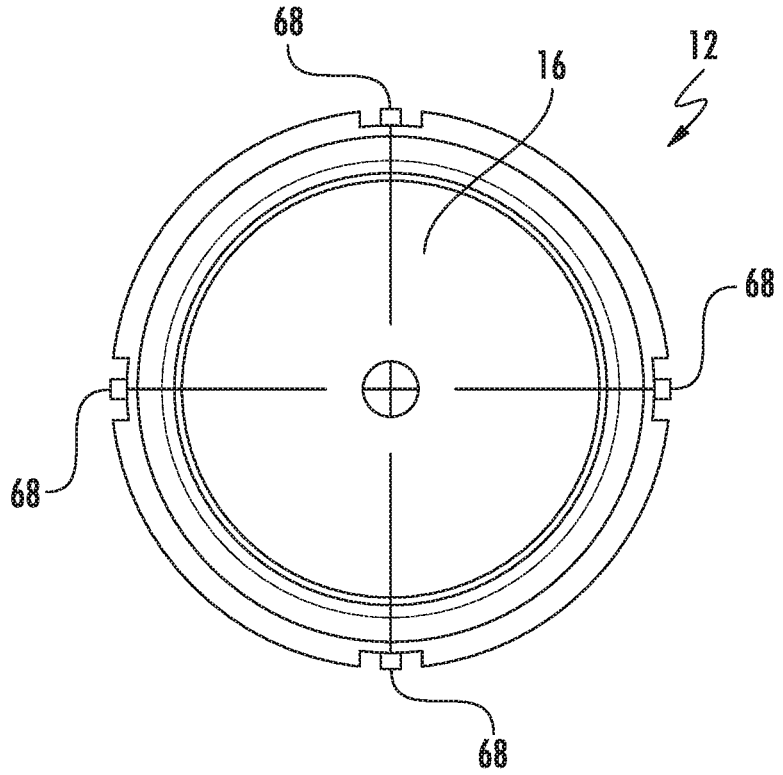
Figure 2F:
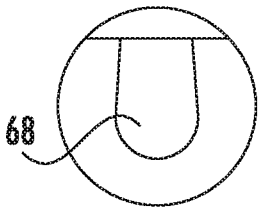
Figure 2G:
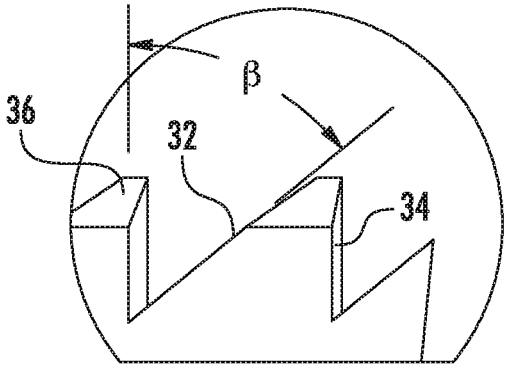

An exterior surface 26 of side wall 18 of inner cap 12 defines a radially outstanding lower skirt 28 on which is provided a series of upwardly projecting teeth 36. The skirt 28 shows the teeth as triangle-shaped or saw-toothed. As shown in FIG. 2G, which is a view of detail area C of FIG. 2D, each saw tooth has a first sloped surface 32 and a second substantially vertical surface 34.

As seen in FIG. 2G, the sloped first surface 32 and the substantially vertical second surface 34 define an angle β preferably ranging from about 30 degrees to about 60 degrees therebetween, and most preferably about 45 degrees. There are preferably thirty-two (32) individual triangular teeth 36 distributed about a radial shoulder 25 of inner cap 12, although, clearly, other numbers of teeth may be employed. Axially offset from the triangular teeth are provided a plurality of protrusions or balls 68 located proximate the top wall 16 and disposed on the side wall 18, as shown in FIG. 2B.

The balls 68 are dimensioned to releasably lock within sockets, as explained below, and preferably extend outwardly from the side wall by an amount equal to a thickness of the triangular teeth 36. In a preferred embodiment, four balls 68 are spaced apart from each other by 90 degrees as shown in FIG. 2E, although more or less balls 68 can be readily employed without departing from the scope of the invention.

Figure 1B:
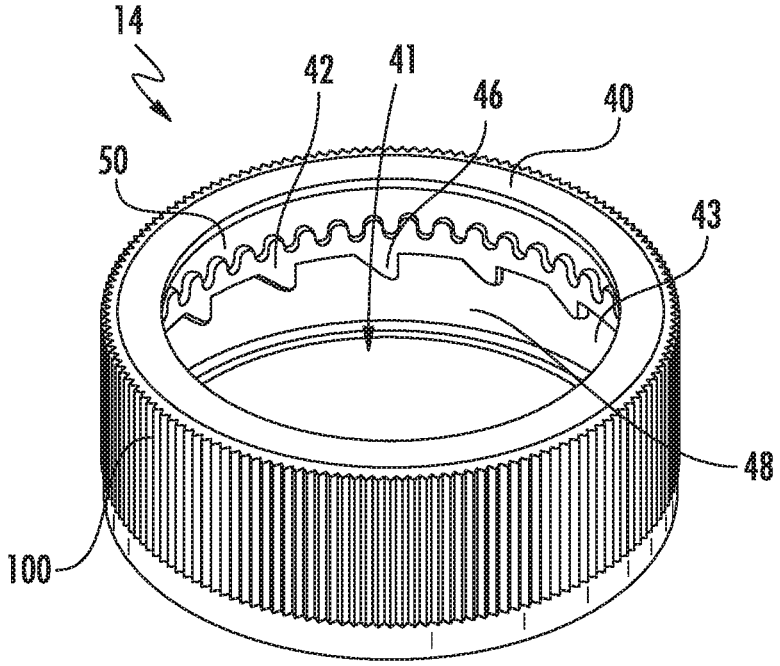
Figure 1C:
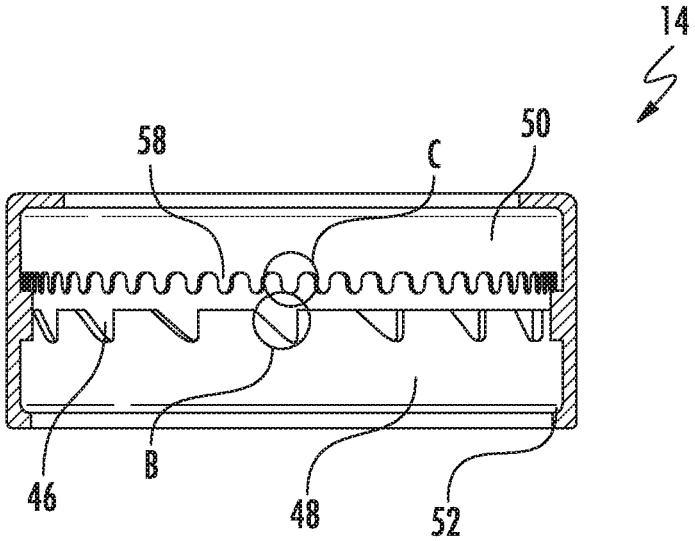
Figure 1D:
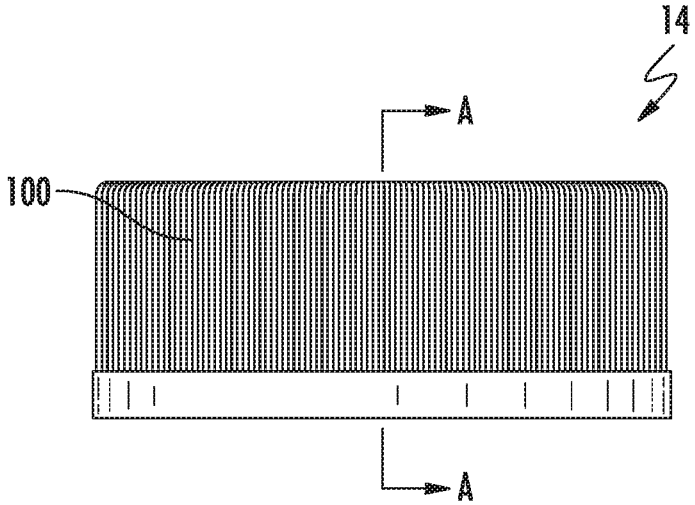
Figure 1E:
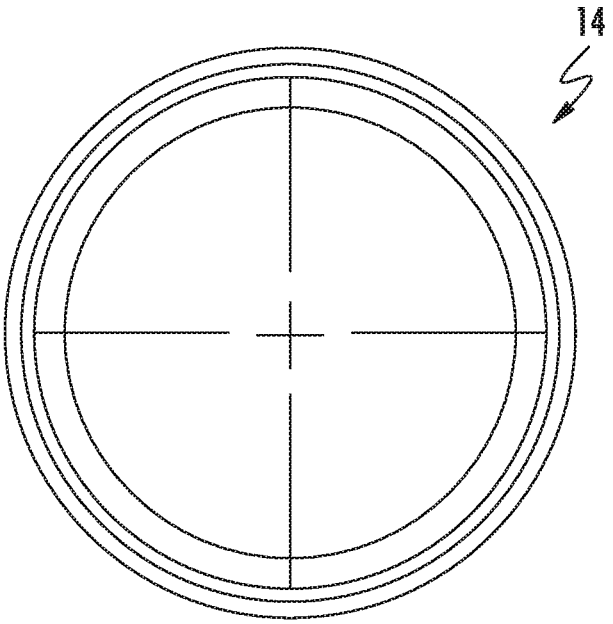

As can be seen in FIGS. 1A to 1G, the outer cap 14 has the annular top wall portion 40 having a central opening 41 and includes a side wall 43 having an inside surface that supports a cylindrical skirt 42 axially offset from the top wall 40. FIG. 1C is a section taken along A-A from FIG. 1D. As illustrated in FIGS. 3A to 3D, the inner cap 12 is nested within outer cap 14 so that the sidewall 43 of outer cap 14 is coaxial with and peripherally surrounding the sidewall 18 of inner cap 12. The outer cap 14 includes a first, child resistant region 48 and a second, non-child resistant region 50, as is shown in FIG. 1A.

The bottom edge of the outer cap sidewall 43 is configured as an inwardly-extending circumferential lip 52 such that a reduced diameter is presented in the region of the lip, as shown in FIG. 1A. The lip 52 is preferably readily deformable or flexible. When the inner cap 14 is positioned in the outer cap 12, by inserting the inner cap top wall 16 into the outer cap end containing the lip 52, a threshold force must be applied so that the inner cap squeezes past the lip 52, thereby causing the lip 52 to function as a yieldable stop to retain the inner cap 14 inside the outer cap 12 once the inner cap 14 is so-positioned.

As shown in FIGS. 1A to 1C, the inner surface 44 of the skirt 42 of the outer cap 14 has a plurality of angularly extending abutment surfaces 46 located in the child resistant region 48 and configured as triangular teeth. These abutment surfaces 46 are angled in the same direction as the angled surfaces 32 of the saw teeth 36 located on the inner cap 12, which can be seen, for example, in FIG. 2G.

Figure 1F:
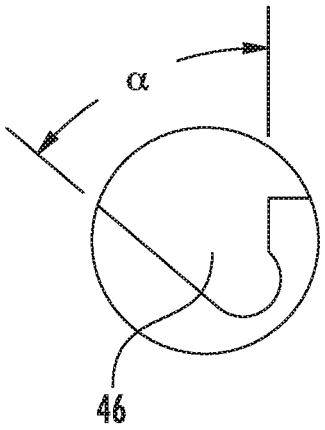

As seen in FIG. 1F, which shows detail area B from FIG. 1C, an angle $\alpha$ is defined between each abutment surface 46 and the vertical or axial. Similar to the angle $\beta$ defined by surfaces 32 and 34 of inner cap projections 30 (see FIG. 2G), the angle $\alpha$ defined between each abutment surface 46 and the vertical or axial is preferably in the range of about 30 degrees to about 60 degrees, and preferably close to, but not identical to, the angle defined by surfaces 32 and 34, with a most preferred angle of 50 degrees.

Figure 3A:
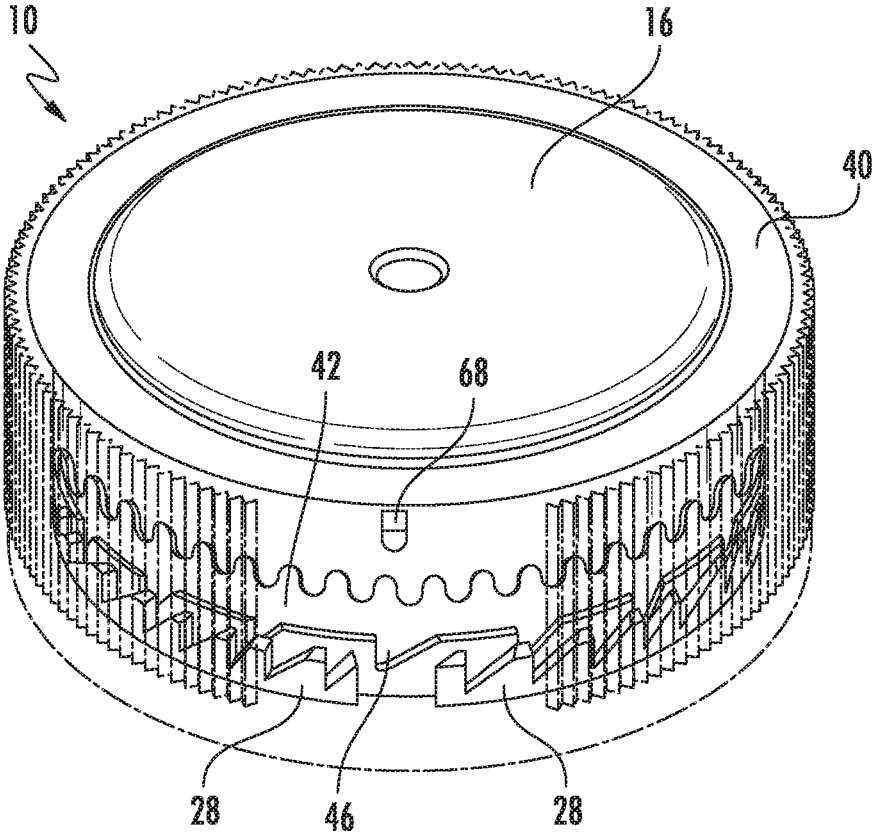
FIGS. 3A-3D show different views of the assembly, namely, the inner cap positioned within the over cap. In particular.
Figure 3B:
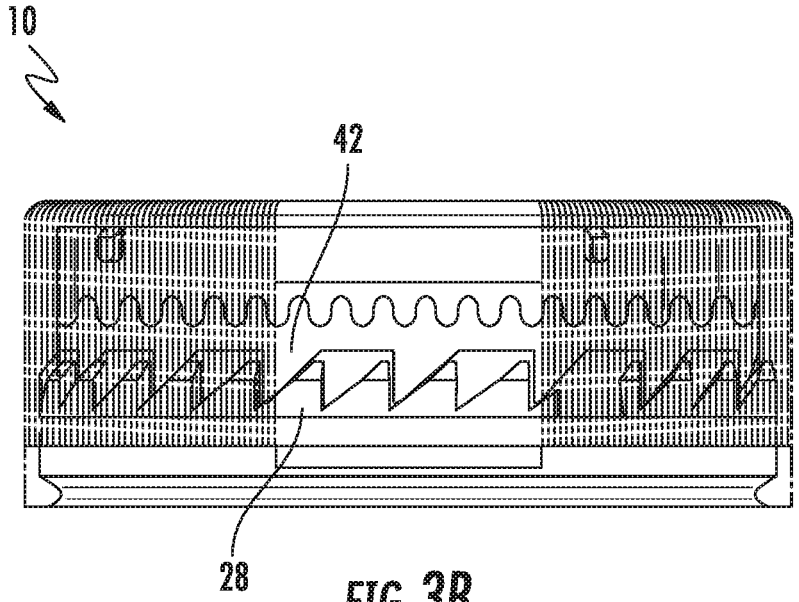
Figure 3C:
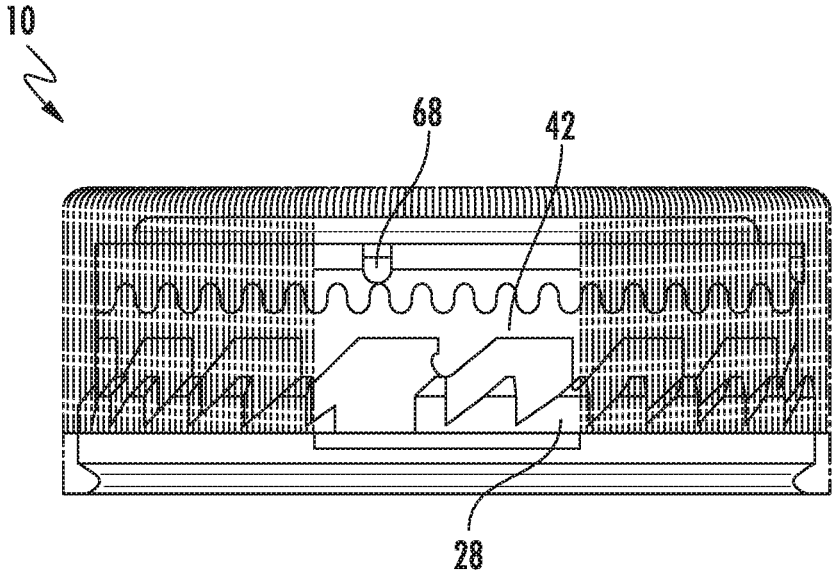

Thus, when the inner cap 12 is positioned in the first or child resistant region 48 of the outer cap 14, as shown in FIG. 3C, and when the outer cap 14 is rotated in the opening direction, the abutment surfaces 46 will ratchet or ride up over the sloped surface 32 of the saw tooth projections 30, thereby preventing rotation of the outer cap 14 relative to the inner cap 12. This, however, can be overcome by the simultaneous application of an opening turning force and an axial force on the outer cap 14 toward the inner cap 12 to engage the vertical edge 34 of teeth 36 with teeth 46 and enable the outer cap 14 to impart rotation to the inner cap 12 so that the two rotate in unison.

Figure 1G:
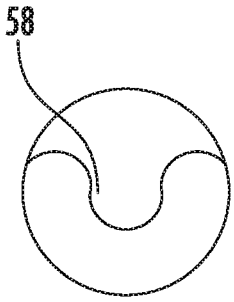

As can be seen, e.g., in FIGS. 1A, 1B and 1G, the outer cap 14 also includes a plurality of preferably equally-dimensioned serpentine sockets 58 positioned on the skirt 42 opposite the teeth 46 such that the sockets 58 extend in the non-child resistant region 50. As can be seen, for example, in FIG. 1C and FIG. 1G, which shows detail area C from FIG. 1C, each socket 58 has a narrowed opening or mouth extending into a main, enlarged socket region and is dimensioned to accommodate the seating of one of the balls 68, shown in detail in FIG. 2F, which shows detail area B from FIG. 2C, in a friction-fit engagement. As shown, the width of the mouth of the sockets 58 is slightly narrower than the widest part of the balls 68 such that a threshold force must be overcome to seat the balls in the sockets 58 by applying an axial force against the cover wall 16 of the inner cap while holding the outer cap stationary.

The balls 68 and sockets 58 are respectively positioned such that each of the balls 68 will seat in a corresponding socket 58, thereby locking the outer and inner caps (14, 12) together. When so-positioned, and as shown in FIG. 3A, which illustrates the cap locked in the non-child resistant position, the teeth 36 are maintained in a position offset from teeth 46. In this non-child resistant position, rotation of the outer cap 14 in either direction will rotate the inner cap 12 by virtue of engagement of the balls 68 and sockets 58.

Operation in the various configurations of the convertible child resistant closure 10 of the invention will now be described with a reference to FIGS. 3A to 3D. For the non-child resistant operation shown in FIG. 3D, the outer (or over) cap 14 is positioned over the inner cap 12 and a downward axial force is applied on the inner cap 12, in particular on the circular upper or top wall 16 of the inner cap 12 while the outer cap is secured such as by being held in place by a user, to securely seat the balls 68 within the sockets 58, thus locking the inner and outer caps together. The closure 10 is then placed on the threaded portion of the container and a rotative force is used to turn the outer cap 14 in the closing, e.g., clockwise, direction.

Gripping of the outer cap 14 is facilitated by a plurality of vertically oriented knurlings 100 formed on the outer surface of the outer cap 14. Such knurlings can be seen in FIGS. 1A, 1B and 1D, as well as in FIGS. 3A to 3D. Thus, as the user rotates outer cap 14 to open or close the container, the rotative force on the outer cap 14 is transmitted to the inner cap 12 through the mated balls 68 and sockets 58 to rotate the inner cap 12, thus threadedly engaging the threaded surface 20 on inner cap 12 with the threaded portion of the container.

It should be appreciated that although the above description and accompanying drawings are directed to an embodiment where the balls 68 are formed on the inner cap 12 and the sockets 58 are formed on the skirt 42 of the outer cap 14, a reverse configuration can be readily employed where the balls are formed on the skirt, and sockets formed in a ring on the inner cap and positioned for engagement with the balls.

Figure 3D:
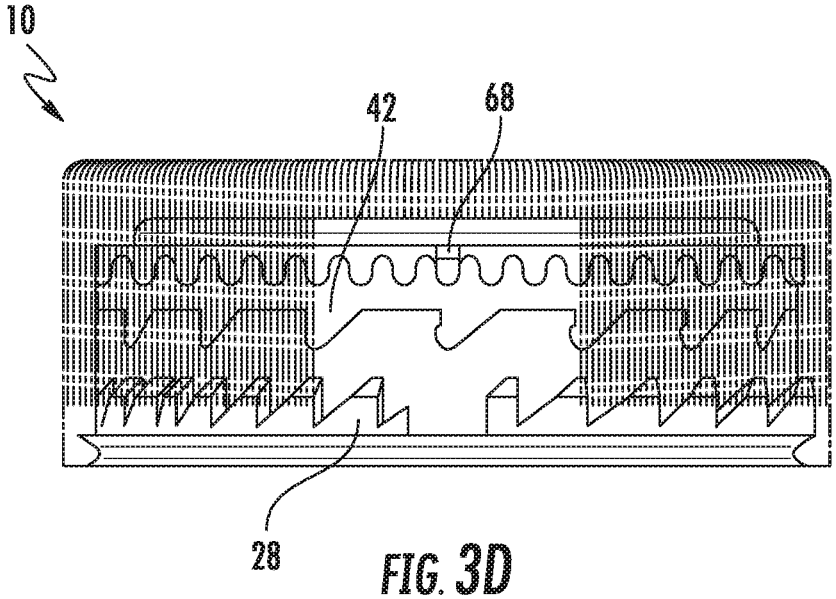

FIG. 3C illustrates the child resistant position of the child resistant closure 10. In order to convert the child resistant closure 10 from the non-child resistant position, as shown in FIG. 3D, to the child resistant position, as shown in FIG. 3C, the user applies a sufficient upwards axial force to inner cap 12 relative to the top wall 40 of the outer cap 14, thus dislodging the balls 68 from the sockets 58 and moving the inner cap 12 to a position above the lip 52 of the outer cap 14 and into the child resistant region 48. (Compare the relative positions of the inner cap and outer cap of FIG. 3C to FIG. 3D). This upward axial force can be applied, for example, by the user placing his or her thumbs underneath the closure and applying upward pressure to the lower/inner side of surface 16 (i.e., pushing up from below) of the inner cap 12 while the outer cap is secured, until the balls 68 dislodge from the sockets 58.

To utilize the closure when in a child resistant position, the closure 10 is first placed on the threaded portion of the container by threadedly engaging the threaded surface 20 on inner cap 12 with the threaded portion of the container. A rotative force coupled with a downward force applied to the outer cap turns the outer cap 14 in the closing direction, here shown to be clockwise.

The vertical surfaces 34 of the teeth 30 on the inner cap 12 and abutment surfaces 46 on the outer cap 14 interengage to cause the inner and outer caps to turn together, e.g., to cause the inner cap 12 to remain rotationally stationary relative to the outer cap 14, to close the container. However, in the child resistant mode, rotation of the closure 10 in the opposite direction, i.e., in an attempt to open the container, without the application of a downward force to the outer cap will cause the abutment surfaces 46 of the outer cap 14 to ratchet or ride over the angled surface 32 of the teeth 30 of the inner cap 12. That is to say, the mere turning of the outer cap 14 in the opening direction will not rotate inner cap 12 in an opening direction because there is no transmission of torque from the outer cap 14 to the inner cap 12 as the abutment surfaces 46 ride over and slide by the angled surfaces 32.

To open the closed container 24 with closure 10 in a child resistant mode, the user must apply both a rotative and a downward axial force. Thus, when the outer cap 14 is rotated in an opening direction, here counterclockwise, while simultaneously applying both a rotational and a downward axial force, the abutment surfaces 46 of the outer cap 14 are prevented from ratcheting over angled surfaces 32 but instead engage one another to transmit torque between abutments 46 and angled surfaces 32 to thereby rotate the inner cap 12 causing it to disengage from the threaded portion 22 of the container 24.

One benefit from the closure described above and depicted in the figures is that by disposing the balls 68 on the inner cap (or outer cap) and the sockets 58 on the outer cap (or inner cap) and dimensioning both such components to be substantially the same thickness—e.g., the outward thickness of the balls with respect to the outer wall of the inner cap, and the outward thickness of the sockets with respect to the inner wall of the outer cap, etc.—the diameters of the caps can provide for a tighter fit, as compared to the prior art embodiments, thereby yielding a closure with decreased cocking between the inner and outer caps which can cause the cap to malfunction.

Each of the inner and outer caps is preferably unitarily formed from plastic materials using known molding techniques.

Although example embodiments have been shown and described in this specification and figures, it would be appreciated by those skilled in the art that changes may be made to the illustrated and/or described example embodiments without departing from their principles and spirit.

What is claimed is:

1. A convertible child resistant closure for a container having a threaded neck, the closure being selectively positionable between a first child resistant position and a second non-child resistant position, the closure comprising:

an outer cap having an outer cap side wall having a top edge, a bottom edge, and an inner surface, and a cylindrical skirt on the inner surface axially offset from the top edge, the inner surface of the outer cap side wall being divided into a first, child resistant region and a second, non-child resistant region, the first region including a plurality of angularly extending abutment surfaces formed on an inner surface of the cylindrical skirt, and the second region being axially offset from the first region and including a plurality of sockets formed on a surface of the cylindrical skirt opposite the inner surface having the angularly extending abutment surfaces; and an inner cap having a cover wall and an inner cap side wall depending from the cover wall, the inner cap side wall having an inner surface threaded for mating engagement with a threaded exterior surface portion of an opening of the container, and an outer surface including a child resistant portion comprising a series of angular abutments extending about the outer surface and a non-child resistant portion axially offset from the child resistant portion and configured as one or more protrusions positioned on the outer surface of the inner cap side wall proximate the cover wall, the inner cap being configured so as to be nestable within the outer cap so that the outer cap side wall is coaxial with and peripherally surrounding the inner cap side wall, wherein each of the plurality of sockets formed on the cylindrical skirt of the outer cap is complementary in shape to each of the one or more protrusions of the inner cap, such that when the one or more protrusions are removably seated within respective ones of the plurality of sockets, thereby angularly and axially locking the outer and inner caps to each other to allow the outer and inner caps to be rotated together about the neck of the container for non-child resistant operation, the closure is positioned in the second non-child resistant position, and when none of the one or more protrusions are seated within any of the plurality of sockets such that the closure can only be opened by application of a rotational and axial force between the plurality of angularly extending abutment surfaces of the outer cap and the angular abutments of the inner cap, the closure is positioned in the first child resistant position.

2. The closure according to claim 1, wherein the angular abutments of the inner cap comprise saw teeth having angled surfaces.

3. The closure according to claim 2, wherein the angularly extending abutment surfaces of the outer cap are angled in a direction identical to that of the angled surfaces of the saw teeth of the inner cap.

4. The closure according to claim 1, wherein a bottom edge of the outer cap side wall is configured as an inwardly-extending circumferential lip such that a reduced diameter of the outer cap is presented in a region of the inwardly-extending circumferential lip, wherein the inwardly extending circumferential lip is deformable such that when the inner cap is positioned in the outer cap, by inserting the inner cap top wall into the outer cap end containing the inwardly-extending circumferential lip, a threshold force must be applied so that the inner cap squeezes past the inwardly-extending circumferential lip, thereby causing the inwardly-extending circumferential lip to function as a yieldable stop to retain the inner cap inside the outer cap once the inner cap is so-positioned.

5. The closure according to claim 4, wherein the closure is movable by a user of the cap between the second non-child resistant position and the first child resistant position by the user applying a sufficient upwards axial force to the inner cap relative to the top wall of the outer cap so as to dislodge the protrusions from the sockets and move the inner cap to a position above the lip of the outer cap and into the first, child resistant, region of the outer cap.

6. The closure according to claim 1, wherein the one or more protrusions consist of four protrusions, each of the four protrusions configured in a shape of a ball, the four balls being spaced apart from each other by 90 degrees.

7. The closure according to claim 1, wherein in both the first child resistant position and the second non-child resistant position, the closure can be closed by application of a rotational and axial force between the threaded inner surface of the inner cap the threaded exterior surface portion of the opening of the container.

8. The closure according to claim 1, wherein, in the first child resistant position, application of a rotational force to the closure to open the container, without the application of a sufficient additional downward force to the outer cap, will cause the abutment surfaces of the outer cap to ratchet or ride over the angular abutments of the inner cap, inhibiting opening of the closure.

9. The closure according to claim 1, wherein the outer cap further comprises a top wall having an opening therein for providing user access to a portion of the inner cap cover wall.

* * * * *